US008262815B2

(12) United States Patent
Hatano et al.

(10) Patent No.: US 8,262,815 B2
(45) **Date of Patent: *Sep. 11, 2012**

(54) HIGH-PURITY FERRITIC STAINLESS STEEL WITH EXCELLENT CORROSION RESISTANCE AND WORKABILITY AND METHOD OF PRODUCTION OF SAME

(75) Inventors: Masaharu Hatano, Tokyo (JP); Akihiko Takahashi, Tokyo (JP)

(73) Assignee: Nippon Steel & Sumikin Stainless Steel Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/735,549

(22) PCT Filed: Jan. 13, 2009

(86) PCT No.: PCT/JP2009/050607

§ 371 (c)(1),
(2), (4) Date: Oct. 12, 2010

(87) PCT Pub. No.: WO2009/096244

PCT Pub. Date: Aug. 6, 2009

(65) Prior Publication Data

US 2011/0236248 A1 Sep. 29, 2011

(30) Foreign Application Priority Data

Jan. 28, 2008 (JP) ..... 2008-016785

(51) Int. Cl.
*C22C 38/18* (2006.01)
*C21D 8/00* (2006.01)

(52) U.S. Cl. ..... 148/325; 148/608; 148/610; 148/651; 148/652; 420/34

(58) Field of Classification Search ..... 148/325, 148/608, 610, 651, 652; 420/34
See application file for complete search history.

(56) References Cited

U.S. PATENT DOCUMENTS 7,056,398 B2 * 6/2006 Yazawa et al. ..... 148/610

FOREIGN PATENT DOCUMENTS

JP 06-172935 6/1994

(Continued)

OTHER PUBLICATIONS

Machine-English translation of Japanese patent 10-183307, Koyama Yuji et al., Jul. 14, 1998.*

(Continued)

*Primary Examiner* — Deborah Yee
(74) *Attorney, Agent, or Firm* — Kenyon & Kenyon LLP

(57) ABSTRACT

The present invention provides high purity ferrite stainless steel able to reduce deterioration in surface conditions due to pitting corrosion or rusting or other corrosion to an extent no different from SUS304 or better without inviting a drop in manufacturability or workability and without relying on the addition of rare elements, and a method of production of the same, that is, ferritic stainless steel containing, by mass %, C: 0.01% or less, Si: 0.01 to 0.20%, Mn: 0.01 to 0.30%, P: 0.04% or less, S: 0.01% or less, Cr: 13 to 22%, N: 0.001 to 0.020%, Ti: 0.05 to 0.35%, Al: 0.005 to 0.050%, Sn: 0.001 to 1%, and a balance of Fe and unavoidable impurities to which Sn is added to modify the passive film and improve the corrosion resistance. To improve the effect of modification of the passive film by the addition of Sn, after the final annealing, the steel is held in the 200 to 700° C. temperature range for 1 minute or more.

9 Claims, 2 Drawing Sheets

FOREIGN PATENT DOCUMENTS

| | | |
|---|---|---|
| JP | 07-034205 | 2/1995 |
| JP | 11-092872 A | 4/1999 |
| JP | 2000-169943 | 6/2000 |
| JP | 2001-288543 | 10/2001 |
| JP | 2001-288544 | 10/2001 |
| JP | 2005-146345 | 6/2005 |
| JP | 2005-220429 | 8/2005 |
| JP | 2007-224342 | 9/2007 |
| JP | 2008-001945 | 1/2008 |
| WO | 2007/129703 | 11/2007 |
| WO | WO 2007/129703 | 11/2007 |

OTHER PUBLICATIONS

Machine-English translation of Japanese patent 2005-220429 , Akihiko et al., Aug. 18, 2005.*

Third party observation dated Nov. 16, 2010 received in corresponding Japanese Application No. 2008-16785.

"Fundamental Studies on Separation of Residual Elements from Steel Scrap", The Iron and Steel Institute of Japan, High Temperature Process Subcommitte, Recyclable Element Separation Research Group, Feb. 29, 1996, p. 9-18.

"Recycling Activity and Task-Sift the High-consumption and Waste Society Towards a Recycling-Oriented Society", The Iron and Steel Institute of Japan, May 2003, p. 105-107, p. 80.

"Effect of Cu and Other Tramp element on Steel Properties", The Iron and Steel Institute of Japan, Material Structure and Property Subcomittee Research Group on Effects of Impurities Derived from Scrap on Steel Materials, Mar. 1997, p. 78-79.

International Search Report dated Apr. 21, 2009 issued in corresponding PCT Application No. PCT/JP2009/050607.

* cited by examiner

HIGH-PURITY FERRITIC STAINLESS STEEL WITH EXCELLENT CORROSION RESISTANCE AND WORKABILITY AND METHOD OF PRODUCTION OF SAME

This application is a national stage application of International Application No. PCT/JP2009/050607, filed 13 Jan. 2009, which claims priority to Japanese Application No. 2008-016785, filed 28 Jan. 2008, which is incorporated by reference in its entirety.

TECHNICAL FIELD

The present invention relates to ferritic stainless steel with excellent corrosion resistance and workability and a method of production of the same.

BACKGROUND ART

Ferritic stainless steel is being used in broad fields such as kitchen equipment, home electrical appliances, electronic devices, etc. However, compared with austenitic stainless steel, it is inferior in workability, so it is limited to these applications in some cases. In recent years, improvements in refining techniques in the production of ferrous metals have enabled reduction of carbon and nitrogen to extremely low levels and reduction of Si plus reduction of P, S, and other impurity elements. Ferritic stainless steel improved in workability by addition of Ti and other stabilizing elements (below, "high purity ferritic stainless steel") is consequently being used for broader applications. This is because ferritic stainless steel is more economical compared with austenitic stainless steel—which contains a large amount of Ni—an element whose price has skyrocketed in recent years.

High purity ferritic stainless steel, as will be understood from SUS430LX standardized by the JIS, is often lower in amount of Cr and has issues in corrosion resistance compared with the typical austenitic stainless steel SUS304 (18Cr-8Ni). Further, for stainless steel sinks and other kitchen equipment and home electrical appliances where a good appearance is sought, the pitting, rusting, and other deterioration in surface properties due to corrosion are often problems.

To solve the above problem of corrosion resistance, there are the method of alloying Cr, Mo, etc. and the method of reforming a coating film formed on the steel surface by bright annealing. The former invites a rise in cost due to the alloying and becomes a factor inhibiting workability, so is not preferred. The latter is an effective method from the perspectives of suppressing a rise in material costs and a drop in workability. Various inventions have been proposed relating to the improvement of the coating film using bright annealing.

From the latter viewpoint, the inventors, in Japanese Patent Application No. 2006-172489, proposed a bright annealed ferritic stainless steel sheet with excellent rustproofness and workability having a ratio of Cr/Fe concentration in the coating film of over 0.5 and containing $TiO_2$ in the coating film and a method of production of the same, but steel with a coating film improved using bright annealing has a problem in terms of securing corrosion resistance at a new surface exposed by working or later polishing or grinding. Measures against this problem were not described in the above patent application.

Further, as a method for solving this problem, it may be considered to utilize trace elements to improve the corrosion resistance. Japanese Patent Publication (A) No. 6-172935 and Japanese Patent Publication (A) No. 7-34205 disclose ferritic stainless steels intentionally adding P to improve the weatherability, rustproofness, and crevice corrosion resistance. Japanese Patent Publication (A) No. 6-172935 is high Cr and P ferritic stainless steel containing Cr over 20% to 40% and P over 0.06% to 0.2%. Japanese Patent Publication (A) No. 7-34205 is P ferritic stainless steel containing Cr 11% to less than 20% and P over 0.04% to 0.2%. However, P becomes a factor inhibiting manufacturability, workability, and weldability, so is not suited for applications where workability is demanded.

Furthermore, Japanese Patent Publication (A) No. 2000-169943 discloses ferritic stainless steel superior in high temperature strength containing trace amounts of Sn and Sb and a method of production of the same. The majority of the steels shown in the examples of Japanese Patent Publication (A) No. 2000-169943 are Cr 10 to 12% low Cr steels. In high Cr steels with Cr over 12%, V, Mo, etc. are added together to secure high temperature strength. As the effects of Sn and Sb, improvement of the high temperature strength may be mentioned. Whether sufficient corrosion resistance can be secured is not disclosed, so remains a question.

Japanese Patent Publication (A) No. 2001-288543 and Japanese Patent Publication (A) No. 2001-288544 disclose ferritic stainless steel with excellent surface characteristics and corrosion resistance using Mg and Ca as trace elements and a method of production of the same. Sn is a selectively added element and is described as an element preferable for the corrosion resistance. The steels shown in the examples of these Japanese Patent Publication (A) No. 2001-288543 and Japanese Patent Publication (A) No. 2001-288544 have Sn and expensive Co added to them together. These steels are 11.6% Cr steels or 16% Cr steels containing large amounts of C and other impurity elements. The pitting potentials are described as being respectively 0.086V and 0.12V. The pitting potentials are lower compared with the pitting potential (over 0.2V) equivalent to SUS304 targeted by the present invention.

Furthermore, WO2007/129703 has as its object the improvement of the pitting lifetime of auto parts etc. and discloses ferritic stainless steel with excellent crevice corrosion resistance using Sn and Sb as trace elements. The steels shown in the examples of this WO2007/129703 improve the pitting resistance at crevice parts by composite addition of Sn and Ni in almost all cases. 16% Cr steel in which Sn is added alone had a high amount of Si and did not correspond to high purity ferritic stainless steel covered by the present invention.

As explained above, the conventional art for improvement of the corrosion resistance utilizing trace elements did not cover addition of P alone or composite addition of Sn or Sb with the expensive rare element Co or Ni or cover the high purity ferritic stainless steel described in lines 13-29 on page 2 and had issues from the viewpoint of manufacturability, workability, and material costs.

DISCLOSURE OF INVENTION

The present invention covers high purity ferritic stainless steel and has as its object the provision of high purity ferritic stainless steel which, without inviting a drop in the manufacturability or workability and without relying on the addition of rare elements, reduces the deterioration of the surface properties due to pitting, rusting, or other corrosion to an extent no different from SUS304 or better than the same. The present invention was made to solve the above problems and has as its gist the following.

(1) High purity ferritic stainless steel with excellent corrosion resistance and workability containing, by mass %, C: 0.01% or less, Si: 0.01 to 0.20%, Mn: 0.01 to 0.30%, P: 0.04% or less, S: 0.01% or less, Cr: 13 to 22%, N: 0.001 to 0.020%, Ti: 0.05 to 0.35%, Al: 0.005 to 0.050%, Sn: 0.001 to 1%, and a balance of Fe and unavoidable impurities.

(2) High purity ferritic stainless steel with excellent corrosion resistance and workability as set forth in (1), characterized in that said steel further contains, by mass %, one or more of Ni: 0.5% or less, Cu: 0.5% or less, Nb: 0.5% or less, Mg: 0.005% or less, B: 0.005% or less, and Ca: 0.005% or less.

(3) High purity ferritic stainless steel with excellent corrosion resistance and workability as set forth in (1) or (2), characterized by having, at a polished steel surface, a pitting potential Vc'100 in a 30° C. 3.5% NaCl aqueous solution of over 0.2V (Vv.s.AGCL).

(4) High purity ferritic stainless steel with excellent corrosion resistance and workability as set forth in any one of (1) to (3) characterized by having a 0.2% yield strength at a tensile test of less than 300 MPa and an elongation at break of 30% or more.

(5) A method of production of high purity ferritic stainless steel with excellent corrosion resistance and workability as set forth in any one of (1) to (4) characterized by hot forging or hot rolling a stainless steel ingot having steel ingredients as set forth in (1) or (2) to obtain a hot rolled steel material, annealing the hot rolled steel material, then repeatedly cold working and annealing it to produce a steel material, during which performing the final annealing at 700° C. or more, then holding the steel at a 200 to 700° C. temperature range for 1 minute or more.

Note that, in the following explanation, the inventions relating to the steels of the above (1) to (4) and the invention relating to the method of production of (5) will be respectively referred to as "the present invention". Further, the combination of the inventions of (1) to (5) will sometimes also be called "the present invention".

BEST MODE FOR CARRYING OUT INVENTION

Figure 1:
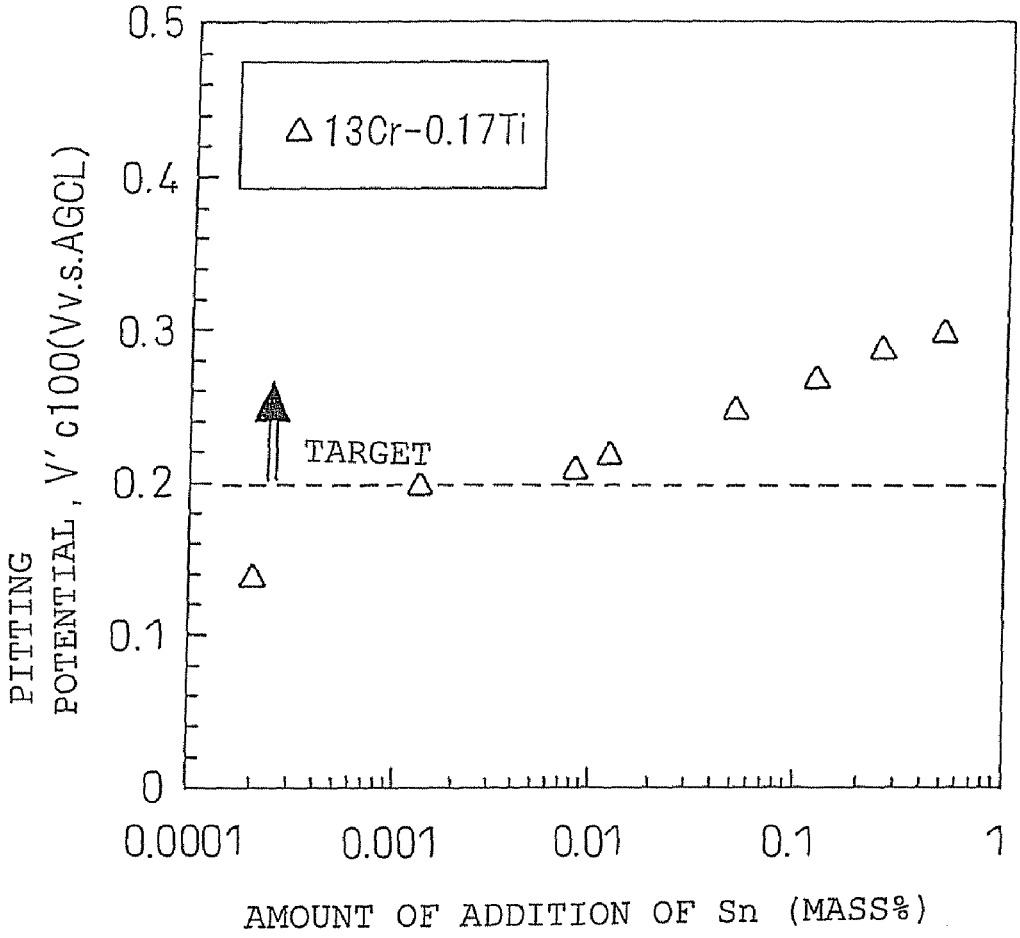
FIG. 1 is a view showing the relationship between the pitting potential and amount of addition of Sn of 13Cr-0.17Ti.

The inventors worked to solve the above problem by engaging in intensive research on the effects of the addition of trace elements, in particular Sn, on the corrosion resistance of high purity ferritic stainless steel and obtained the following new findings:

(a) For high purity ferritic stainless steel, as shown by the experimental results in FIG. 1, if adding 0.001% or more of Sn alone, the pitting potential is improved. They discovered that if adding Sn to Cr: 13% or more steel, a pitting potential exceeding 0.2V, no different from SUS304, is achieved.

(b) In recent years, the corrosion resistance of stainless steel has increasingly been simply evaluated, not only by manufacturers but also by individual users, by accelerated tests such as the salt spray test. Steel having a pitting potential over 0.2V described in the above (a) can be reduced in deterioration of surface properties due to pitting, rusting, or other corrosion in these simplified evaluations to an extent no different from SUS304 or better than the same.

Figure 2:
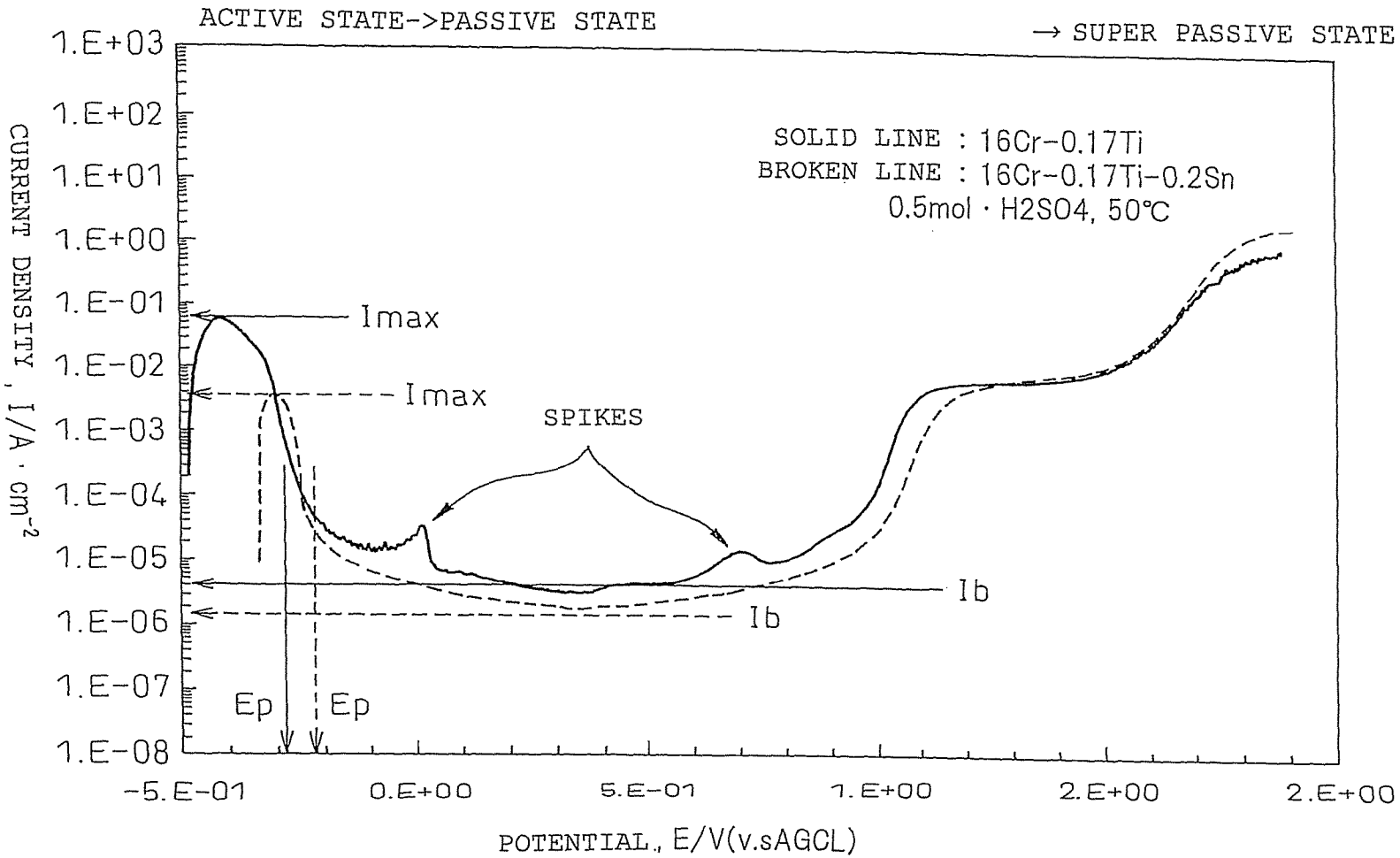
FIG. 2 is a view of examples of anodic polarization curves in a dilute sulfuric acid solution.

(c) Regarding the above action in improving the corrosion resistance, anodic polarization curves were measured in a dilute sulfuric acid solution and electrochemically studied. FIG. 2 shows examples of anodic polarization curves. Sn steel, compared with steel not having Sn added to it, has smaller absolute values of the boundary potential of transition from the active state to the passive state (passivation potential Ep, negative value) and the maximum solubility current (passivation critical current: Imax, positive value) and is more easily passivated. Furthermore, no spike etc. showing disturbances are seen in the steady-state solubility current in the passive state (passivation holding current: Ib), so the passivation can be interpreted as being stable. The results of these electrochemical studies back up the assertion that the addition of Sn results in improvement of the passivation film and improvement of the corrosion resistance.

(d) Sn is a solution strengthening element. It raises the strength of the material and lowers the elongation. However, if covering high purity ferritic stainless steel, by controlling the amount of Cr and the amount of addition of Sn, in addition to the above action in improving the corrosion resistance, it is possible to secure softness and high ductility workability.

(e) The inventors discovered that composite addition of Sn and 0.5% or less of Cu or Ni enhances the effect of the action of raising the corrosion resistance and in addition is sometimes effective for improving the workability (elongation, r value).

(f) The inventors discovered that for the improvement of the corrosion resistance by the addition of Sn, after final annealing of the steel material, retention at a 200 to 700° C. temperature range is an effective means. While details are not clear, from XPS analysis, it is guessed that the concentration of Sn at the passivation film and directly below the film acts to improve the corrosion resistance.

(g) Sn is a low melting point metal and was expected to induce melt embrittlement at the time of hot working. However, Sn has a large diffusion in the temperature region at the time of hot working and there is also the solubility of the steel, so as long as not excessively adding this over 1%, the inventors confirmed the manufacturability is not impaired.

Note that, pitting potential is measured in a 30° C., 3.5% sodium chloride aqueous solution in the state with the surface of the steel polished by emery paper #600. The electrode was made AgCl, and the value of the pitting potential V'c100 was measured. The strength and elongation of the material were the values, in the case of sheet, obtained by sampling JIS13B tensile test pieces from the rolling direction and testing them by a tensile speed of 20 mm/min. The presence of Sn at the passivation film and directly below the film can be analyzed by X-ray photoelectron spectroscopy (XPS). The polished sample surface was made the analyzed surface. The presence of Sn could be confirmed by detection of peaks near 484 to 487 eV.

The present invention of the above (1) to (4) was completed based on the findings of the above (a) to (g). Below, the requirements of the present invention will be explained in detail. Note that the "%" expressions of the contents of the elements mean "mass %".

First, the ingredients in the present invention and the reasons for limiting them will be explained.

C degrades the workability and corrosion resistance, so the smaller its content, the better, therefore the upper limit is made 0.010%. However, excessive reduction would lead to an increase in refining costs, so preferably the lower limit is made 0.001%. More preferably, considering the corrosion resistance and manufacturing cost, the content is made 0.002 to 0.005%.

Si is sometimes added as a deoxidizing element. However, it is a solution strengthening element, so for suppression of the drop in elongation, the smaller its content, the better. Therefore, the upper limit is made 0.20%. However, excessive reduction would lead to an increase in refining costs, so the lower limit is made 0.01%. Preferably, considering the workability and manufacturing cost, the content is made 0.03 to 0.15%.

Mn, like Si, is a solution strengthening element, so the smaller the content, the better. For suppression of the drop in elongation, the upper limit is made 0.30%. However, excessive reduction would lead to an increase in refining costs, so the lower limit is made 0.01%. Preferably, considering the workability and manufacturing cost, the content is made 0.03 to 0.15%.

P, like Si and Mn, is a solution strengthening element, so the smaller the content the better. To suppress the drop in elongation, the upper limit is made 0.040%. However, excessive reduction would lead to an increase in the refining costs, so preferably the lower limit is made 0.005%. More preferably, considering the manufacturing cost and workability, the content is made 0.010 to 0.020%.

S is an impurity element. It obstructs the hot workability and corrosion resistance, so the content should be as small as possible. For this reason, the upper limit is made 0.010%. However, excessive reduction would lead to an increase in the refining costs, so preferably the lower limit is made 0.0001%. More preferably, considering the corrosion resistance and manufacturing costs, the content is made 0.0010% to 0.0050%.

Cr is an essential element for securing corrosion resistance. To secure the pitting potential of the present invention, the lower limit is made 13%. However, over 22% addition would lead to a rise in material costs and a drop in workability and manufacturability. Therefore, the upper limit of Cr is made 22%. Preferably, considering the corrosion resistance, workability, and manufacturability, the content is made 15 to 18%.

N, like C, degrades the workability and corrosion resistance, so its content is as small as possible. Therefore, the upper limit is made 0.020%. However, excessive reduction would mean failure of precipitation of TiN serving as nuclei for formation of ferrite grains at the time of solidification and therefore the formation of the solidified structure in a columnar crystal state and possible deterioration of the ridging resistance of the product. For this reason, the lower limit is made 0.001%. Preferably, considering the workability and corrosion resistance, the content is made 0.003 to 0.012%.

Ti is an element extremely effective for immobilizing the C and N for obtaining softness and improving the elongation and r value, so the lower limit is made 0.05%. However, Ti is also a solution strengthening element. Excessive addition would lead to a drop in elongation. Therefore, the upper limit is made 0.35%. Preferably, considering the workability and corrosion resistance, the content is made 0.10 to 0.20%.

Al is an element effective as a deoxidizing element, so the lower limit is made 0.005%. However, excessive addition would cause deterioration of the workability and toughness and weldability, so the upper limit is made 0.05%. Preferably, considering the refining costs, the content is made 0.01 to 0.03%.

Sn is an essential element for securing the corrosion resistance targeted by the present invention without relying on alloying of Cr and Mo and addition of the rare elements Ni, Co, etc. To obtain the pitting potential targeted by the present invention, the lower limit is made 0.001%. Preferably, as will be understood from the text results of FIG. 1, the content is made 0.01% or more. However, excessive addition would lead to a drop in the workability and manufacturability pointed out in lines 3-9, 23-29 on page 7. The effect of improvement of the corrosion resistance would also be saturated. For this reason, the upper limit is made 1%. Preferably, the upper limit is made 0.8% considering the workability and the manufacturability. More preferably, from the balance of the corrosion resistance and the workability and manufacturability, the content is made 0.05 to 0.5%.

Ni and Cu are elements improving the corrosion resistance by a synergistic effect with Sn and are added accordance with need. Further, these elements have actions improving the workability (elongation, r value) along with the addition of Sn. When added, the content is made 0.05% or more where the effect is manifested. However, if over 0.5%, this would invite a rise in the material cost and a drop in the workability, so the upper limit is made 0.5%. More preferably, it is made 0.1 to 0.3%.

Nb, like Ti, is an element effective for improving the elongation and r value and improving the corrosion resistance and is added in accordance with need. When added, the content is made 0.05% or more where the effect is manifested. However, excessive addition would cause a rise in the material cost and a drop in the elongation, so the upper limit is made 0.5%. Preferably, considering the workability and corrosion resistance, the content is made 0.2 to 0.4%.

Mg forms Mg oxides together with Al in molten steel to act as a deoxidizing agent and also acts as a nuclei for precipitation of TiN. TiN forms solidification nuclei for the ferrite phase in the solidification process. By promoting the precipitation of TiN, it is possible to make the ferrite phase form finely at the time of solidification. By making the solidified structure finer, it is possible to prevent surface defects in the product caused by ridging, roping, and other coarse solidified structures. In addition, this is added in accordance with need so as to improve the workability. When added, the content is made 0.0001% where the effect is manifested. However, if over 0.005%, the manufacturability deteriorates, so the upper limit is made 0.005%. Preferably, considering the manufacturability, the content is made 0.0003 to 0.002%.

B is an element improving the hot workability and the secondary workability. Addition to Ti steel is effective. Ti steel immobilizes the C by Ti, so the strength of the grain boundaries falls and, at the time of secondary working, grain boundary cracks more easily form. When added, the content is made 0.0003% or more where the effect is manifested. However, excessive addition would cause a drop in the elongation, so the upper limit is made 0.005%. Preferably, considering the material cost and the workability, the content is made 0.0005 to 0.002%.

Ca is an element improving the hot workability and the cleanliness of the steel and is added in accordance with need. When added, the content is made 0.0003% or more where the effect is manifested. However, excessive addition would lead to a drop in the manufacturability and a drop in the corrosion resistance due to CaS and other water soluble inclusions, so the upper limit is made 0.005%. Preferably, considering the manufacturability and corrosion resistance, the content is made 0.0003 to 0.0015%.

The high purity ferritic stainless steel having the composition of the present invention can be given a pitting potential, an indicator of corrosion resistance, of more than 0.2V, a 0.2% yield strength of less than 300 MPa, and an elongation at break of at least 30% and can be given a corrosion resistance no different from SUS304 or better than the same without inviting a drop in the workability. The measurement conditions for the pitting potential, the 0.2% yield strength, and the elongation at break are described in lines 30-37 on page 7 and lines 1-6 on page 8.

(B) Next, the method of production of the present invention and the reasons for limitation of the same will be explained.

In the present invention, if satisfying the composition described in the above section (A), even if produced under usual process conditions, the corrosion resistance and workability can be sufficiently secured, but in addition to the above process, it is preferable to final anneal the steel at 700° C. or more, then hold it at a 200 to 700° C. temperature region for 1 minute or more.

The final annealing is made 700° C. or more to cause the steel after cold working to recrystallize and thereby secure workability. An excessive rise in the annealing temperature would cause the crystal grain size to coarsen and would lead to roughening of the skin due to working and a drop in the surface quality. Preferably, the upper limit of the annealing temperature is made 950° C.

After the final annealing, to hold the steel in the 200 to 700° C. temperature region for 1 minute or more, the cooling rate may be adjusted or the steel may be reheated to 200 to 700° C. and then held there for 1 minute or more. If over 700° C., precipitates including Ti or P would form and lead to a drop in the corrosion resistance, so the upper limit is made 700° C. If less than 200° C., the effect of further improvement of the corrosion resistance described in lines 15-22 on page 7 cannot be expected. Therefore, the lower limit is made 200° C. More preferably, the temperature is made a range of 300 to 600° C. The retention time at 200 to 700° C. is preferably 1 minute or more for obtaining the above effects. No upper limit is particularly set, but when using an industrial continuous annealing facility, not more than 5 minutes is preferable. More preferably, the time is not more than 3 minutes.

EXAMPLES

Below, examples will be explained for the case where the present invention is steel sheet.

Ferritic stainless steel having each of the compositions of Table 1 was smelted and hot rolled at a heating temperature of 1150 to 1200° C. to obtain a 3.8 mm thick hot rolled steel sheet. The hot rolled steel sheet was annealed, pickled, then cold rolled to a thickness of 0.8 mm, then was final annealed and was used for evaluation of the corrosion resistance and mechanical properties. The steel compositions were ones in the range prescribed by the present invention and other ranges. The cooling after the final annealing was performed under conditions limited by the present invention and other conditions. For the comparative steel, SUS304 (18% Cr-8% Ni) was used.

The corrosion resistance was evaluated by measurement of the pitting potential and by a salt spray test and CASS test. The pitting potential was measured by the method described in lines 30-37 on page 7 and lines 1-6 on page 8. The salt spray test and the CASS test were performed by methods based on JISZ2371. For the tests, in each case, final annealed steel sheet (material) and a worked product obtained by cylindrically deep drawing the material were used. The surface of the material was polished by emery paper #600 in the same way as measurement of the pitting potential and made the test surface in that state. The cylindrical deep drawing was performed using a blank diameter of ϕ80 mm, a punch diameter of ϕ40 mm, a die diameter of ϕ42 mm, and a wrinkle suppression pressure of 1 ton. For lubrication, a film was used. The number of test days was made 15 days (360 hr). The extent of rusting was compared with SUS304. When good, it was indicated as "VG (very good)", when no different, as "G (good)", and when inferior as "P (poor)". Further, the mechanical properties were measured by the methods described in lines 30-37 on page 7 and lines 1-6 on page 8.

Table 2 summarizes the test results. From Table 2, Test Nos. 1 to 9 are high purity ferritic stainless steels satisfying the composition requirements of the present invention, had pitting potentials Vc'100 of over 0.2V (Vv.s.AGCL), had 0.2% yield strengths of less than 300 MPa, and had elongations at break of 30% or more as mechanical properties. These steel sheets are provided with corrosion resistances of extents no different from or better than the SUS304 of Test No. 12 in the salt spray test or CASS test.

As opposed to this, Test Nos. 10 and 11 correspond to the JIS standard SUS430LX and are steel sheets without the Sn added as prescribed in the present invention. Test No. 10 has mechanical properties of a 0.2% yield strength of less than 300 MPa and an elongation at break of 30% or more, but is inferior in corrosion resistance compared with SUS304. On the other hand, Test No. 11 has a corrosion resistance no different from SUS304, but does not satisfy the mechanical properties prescribed in the present invention. Due to this, Test Nos. 1 to 9 of the invention examples were recognized to be remarkably improved in corrosion resistance without impairing the excellent mechanical properties (softness and high elongation) of JIS standard steel.

Test Nos. 2 and 6 of the invention examples used the method of production prescribed in the present invention. Compared with Test Nos. 1 and 5 not using this, an improvement in the corrosion resistance could be confirmed. Test No. 4 is improved in elongation by the addition of a trace amount of Cu.

TABLE 1

| | Compositions of Test Steels (mass %) | | | | | | | | | | | | | | | |
|---|---|---|---|---|---|---|---|---|---|---|---|---|---|---|---|---|
| | C | Si | Mn | P | S | Cr | N | Ti | Al | Sn | Ni | Cu | Nb | Mg | B | Ca |
| A | 0.003 | 0.12 | 0.10 | 0.015 | 0.0020 | 13.8 | 0.010 | 0.18 | 0.023 | 0.008 | — | — | — | — | — | — |
| B | 0.004 | 0.12 | 0.09 | 0.015 | 0.0016 | 16.2 | 0.009 | 0.17 | 0.012 | 0.480 | — | — | — | — | — | — |
| C | 0.004 | 0.12 | 0.10 | 0.014 | 0.0010 | 16.2 | 0.010 | 0.18 | 0.013 | 0.210 | — | 0.29 | — | — | — | — |
| D | 0.003 | 0.04 | 0.08 | 0.016 | 0.0015 | 16.6 | 0.008 | 0.20 | 0.040 | 0.180 | — | — | — | 0.0003 | 0.0009 | — |
| E | 0.004 | 0.10 | 0.13 | 0.031 | 0.0020 | 21.0 | 0.007 | 0.27 | 0.046 | 0.055 | 0.28 | 0.43 | — | 0.0003 | 0.0006 | 0.0004 |
| F | 0.007 | 0.15 | 0.20 | 0.035 | 0.0011 | 19.4 | 0.010 | 0.08 | 0.020 | 0.075 | 0.29 | 0.40 | 0.38 | — | — | — |
| G | 0.009 | 0.11 | 0.07 | 0.012 | 0.0012 | 13.2 | 0.016 | 0.33 | 0.040 | 0.800 | — | — | — | 0.0003 | 0.0020 | 0.0005 |
| H | 0.003 | 0.04 | 0.10 | 0.010 | 0.0026 | 16.3 | 0.007 | 0.18 | 0.016 | — | — | — | — | 0.0005 | 0.0008 | — |
| I | 0.013 | 0.55 | 0.15 | 0.030 | 0.0020 | 19.2 | 0.013 | 0.10 | 0.025 | — | 0.35 | 0.45 | 0.37 | — | — | — |

(Note 1)

"—" means not added.

(Note 2)

"H" and "I" are outside from ingredients of the present invention.

TABLE 2

Results of Evaluation of Corrosion Resistance and Mechanical Properties

| | No. | Steel | Retention time at 200 to 700° C. (min) | Pitting potential $V'_{c100}$ (Vv.s. AGCL) | Salt spray test Material | Salt spray test Worked product | CASS test Material | CASS test Worked product | Mechanical properties 0.2% PS | Mechanical properties EL |
|---|---|---|---|---|---|---|---|---|---|---|
| Inv. ex. | 1 | A | 0.3 | 0.24 | G | G | G | VG | 210 | 35 |
| | 2 | | 4 | 0.27 | G | G | G | VG | 220 | 34 |
| | 3 | B | 0.3 | 0.35 | VG | G | G | VG | 235 | 32 |
| | 4 | C | 0.4 | 0.36 | VG | G | G | VG | 270 | 36 |
| | 5 | D | 0.3 | 0.35 | VG | G | G | VG | 230 | 34 |
| | 6 | | 5 | 0.38 | VG | VG | VG | VG | 235 | 33 |
| | 7 | E | 0.5 | 0.40 | VG | VG | VG | VG | 290 | 32 |
| | 8 | F | 0.3 | 0.38 | VG | VG | VG | VG | 280 | 31 |
| | 9 | G | 0.3 | 0.30 | G | G | G | VG | 270 | 32 |
| Comp. ex. | 10 | H | — | 0.19* | P | P | P | G | 260 | 33 |
| | 11 | I | | 0.25 | G | G | G | VG | 330* | 30* |
| | 12 | SUS304 | | 0.28 | | Comparison criteria | | | 270 | 51 |
| | | | | | | | | | $N/mm^2$ | % |

(Note 1)
Salt spray test and CASS test evaluations: "VG (very good)": excellent, "G (good)": no different, and "P (poor)": inferior compared with SUS304.
(Note 2)
Salt spray and CASS test results of SUS304: rust points formed, CASS test of worked product -> stress corrosion cracks (SCC) occurred.
(Note 3)
Asterisks indicate outside present invention.

Industrial Applicability

According to the present invention, the remarkable effect is exhibited that it is possible to obtain high purity ferritic stainless steel with excellent corrosion resistance and workability provided with, without inviting a rise in material costs or a drop in manufacturability, a pitting potential Vc'100 in a 30° C., 3.5% NaCl aqueous solution of over 0.2V (Vv.s.AGCL) and a corrosion resistance of an extent no different from SUS304 or better than the same and having mechanical properties of a 0.2% yield strength in a tensile test of less than 300 MPa and an elongation at break of 30% or more.

The invention claimed is:

1. High purity ferritic stainless steel with excellent corrosion resistance and workability containing, by mass %, C: 0.01% or less, Si: 0.01 to 0.20%, Mn: 0.01 to 0.30%, P: 0.04% or less, S: 0.01% or less, Cr: 13 to 22%, N: 0.001 to 0.020%, Ti: 0.05 to 0.35%, Al: 0.005 to 0.050%, Sn: 0.001 to 1%, and a balance of Fe and unavoidable impurities, the high purity ferritic stainless steel containing a passivation film, wherein Sn is concentrated at the passivation film and directly below the film.

2. High purity ferritic stainless steel with excellent corrosion resistance and workability as set forth in claim 1, characterized in that said steel further contains, by mass %, one or more of Ni: 0.5% or less, Cu: 0.5% or less, Nb: 0.5% or less, Mg: 0.005% or less, B: 0.005% or less, and Ca: 0.005% or less.

3. High purity ferritic stainless steel with excellent corrosion resistance and workability as set forth in claim 1 or 2, characterized by having, at a polished steel surface, a pitting potential Vc'100 in a 30° C. 3.5% NaCl aqueous solution of over 0.2V (Vv.s.AGCL).

4. High purity ferritic stainless steel with excellent corrosion resistance and workability as set forth in claim 1 or 2 characterized by having a 0.2% yield strength at a tensile test of less than 300 MPa and an elongation at break of 30% or more.

5. A method of production of high purity ferritic stainless steel with excellent corrosion resistance and workability, characterized by hot forging or hot rolling a stainless steel ingot containing, by mass %, C: 0.01% or less, Si: 0.01 to 0.20%, Mn: 0.01 to 0.30%, P: 0.04% or less, S: 0.01% or less, Cr: 13 to 22%, N: 0.001 to 0.020%, Ti: 0.05 to 0.35%, Al: 0.005 to 0.050%, Sn: 0.001 to 1%, and a balance of Fe and unavoidable impurities to obtain a hot rolled steel material, annealing the hot rolled steel material, then repeatedly cold working and annealing it to produce a steel material, during which performing the final annealing at 700° C. or more, then holding the steel at a 200 to 700° C. temperature range for 1 minute or more.

6. High purity ferritic stainless steel with excellent corrosion resistance and workability as set forth in claim 3 characterized by having a 0.2% yield strength at a tensile test of less than 300 MPa and an elongation at break of 30% or more.

7. The method of production of high purity ferritic stainless steel with excellent corrosion resistance and workability as set forth in claim 5, characterized in that said steel further contains, one or more of Ni: 0.5% or less, Cu: 0.5% or less, Nb: 0.5% or less, Mg: 0.005% or less, B: 0.005% or less, and Ca: 0.005% or less.

8. The method of production of high purity ferritic stainless steel with excellent corrosion resistance and workability as set forth in claim 5 or 7, wherein the steel is characterized by having, at a polished steel surface, a pitting potential Vc'100 in a 30° C. 3.5% NaC1 aqueous solution of over 0.2V (Vv.s.AGCL).

9. The method of production of high purity ferritic stainless steel with excellent corrosion resistance and workability as set forth in claim 5 or 7, wherein the steel is characterized by having a 0.2% yield strength at a tensile test of less than 300 MPa and an elongation at break of 30% or more.

* * * * *